US010376011B2

(12) United States Patent
Erb et al.

(10) Patent No.: US 10,376,011 B2
(45) Date of Patent: Aug. 13, 2019

(54) FOOTBALL HELMET WITH RAISED PLATEAU

(71) Applicant: KRANOS IP CORPORATION, Litchfield, IL (US)

(72) Inventors: Robert Erb, Plandome, NY (US); Cortney Warmouth, Edwardsville, IL (US); Vincent R. Long, St. Peters, MO (US); Louis Anthony Vanhoutin, Luka, IL (US)

(73) Assignee: KRANOS IP CORPORATION, Litchfield, IL (US)

( * ) Notice: Subject to any disclaimer, the term of this patent is extended or adjusted under 35 U.S.C. 154(b) by 0 days.

(21) Appl. No.: 16/360,076

(22) Filed: Mar. 21, 2019

(65) Prior Publication Data

US 2019/0216160 A1 Jul. 18, 2019

Related U.S. Application Data

(63) Continuation of application No. 16/139,951, filed on Sep. 24, 2018, now Pat. No. 10,258,100, which is a (Continued)

(51) Int. Cl.

| | |
|---|---|
| ***A42B 3/00*** | (2006.01) |
| ***A42B 3/20*** | (2006.01) |
| ***A42B 3/12*** | (2006.01) |

(52) U.S. Cl.

CPC ..... *A42B 3/20* (2013.01); *A42B 3/124* (2013.01); *A42B 3/125* (2013.01); *A42B 3/127* (2013.01); *A42B 3/128* (2013.01)

(58) Field of Classification Search

CPC ..... A42B 3/20; A42B 3/124; A42B 3/125; A42B 3/127; A42B 3/128

See application file for complete search history.

(56) References Cited

U.S. PATENT DOCUMENTS

| | | | |
|---|---|---|---|
| 1,244,559 | A | 10/1917 | Stocks |
| 1,522,952 | A | 1/1925 | Goldsmith |

(Continued)

FOREIGN PATENT DOCUMENTS

| | | | |
|---|---|---|---|
| GB | 2535639 | A | 8/2016 |
| WO | 9626654 | A1 | 9/1996 |
| WO | 9733494 | A1 | 9/1997 |

OTHER PUBLICATIONS

International Search Report for corresponding parent PCT/US20111045071, dated Dec. 19, 2011.

(Continued)

*Primary Examiner* — Richale L Quinn

(74) *Attorney, Agent, or Firm* — Notaro, Michalos & Zaccaria P.C.

(57) ABSTRACT

A football helmet has a rigid plastic football helmet shell with a raised plateau of the shell extending from the front portion, over the crown portion, toward the back portion. This raised plateau is the only raised plateau of the shell which begins in the front portion, extends over the crown portion, and ends in the back portion. The raised plateau has a left border and a right border. The left border is composed of a plurality of segments and extends continuously from the front portion, over the crown portion, toward the back portion. The segments of the left border including at least a first segment and second segment, which meet to form an angle. A non-circular first ventilation hole through the shell has at least a first side, a second side, and a third side, and is positioned at the angle, such that the first side is adjacent to the first segment and the second side is adjacent to the second segment. The first segment extends beyond the first ventilation hole by a first distance at least as long as the first side and the second segment extending beyond the first (Continued)

ventilation hole by a second distance at least as long as the second side.

10 Claims, 10 Drawing Sheets

Related U.S. Application Data continuation of application No. 15/799,335, filed on Oct. 31, 2017, now Pat. No. 10,098,406, which is a continuation of application No. 14/815,596, filed on Jul. 31, 2015, now Pat. No. 9,326,561, which is a continuation of application No. 14/815,491, filed on Jul. 31, 2015, now Pat. No. 9,833,033, which is a continuation of application No. 13/526,077, filed on Jun. 18, 2012, now Pat. No. 9,131,744.

(56) References Cited

U.S. PATENT DOCUMENTS

| | | | |
|---|---|---|---|
| 2,140,716 | A | 12/1938 | Pryale |
| 3,039,109 | A | 10/1958 | Simpson |
| 3,086,899 | A | 4/1963 | Smith |
| 3,116,490 | A | 1/1964 | Zbikowski |
| 3,153,792 | A | 10/1964 | Marietta |
| 3,166,761 | A | 1/1965 | Strohm |
| 3,186,004 | A | 6/1965 | Carlini |
| 3,197,784 | A | 8/1965 | Carlisle |
| 3,208,080 | A | 9/1965 | Hirsch |
| 3,273,162 | A | 9/1966 | Andrews, III |
| 3,373,443 | A | 3/1968 | Marietta |
| 3,582,990 | A | 6/1971 | Frieder |
| 3,609,764 | A | 10/1971 | Morgan |
| 3,616,463 | A | 11/1971 | Theodore |
| 3,713,640 | A | 1/1973 | Margan |
| 3,761,959 | A | 10/1973 | Dunning |
| 3,843,970 | A | 10/1974 | Marietta |
| 3,872,511 | A | 3/1975 | Nicholas |
| 3,882,547 | A | 5/1975 | Morgan |
| 4,023,213 | A | 5/1977 | Rovani |
| 4,101,983 | A | 7/1978 | Dera |
| 4,134,155 | A | 1/1979 | Robertson |
| 4,168,542 | A | 9/1979 | Small |
| 4,223,409 | A | 9/1980 | Lee |
| 4,233,409 | A | 9/1980 | Lee |
| 4,239,106 | A | 12/1980 | Aileo |
| 4,282,610 | A | 8/1981 | Steigerwald |
| 4,287,613 | A | 9/1981 | Schulz |
| 4,300,242 | A | 11/1981 | Nava et al. |
| 4,307,471 | A | 12/1981 | Lovell |
| 4,345,338 | A | 8/1982 | Frieder |
| D267,287 | S | 12/1982 | Gooding |
| 4,370,759 | A | 2/1983 | Zide |
| 4,404,690 | A | 9/1983 | Farquharson |
| 4,432,099 | A | 2/1984 | Grick |
| 4,466,138 | A | 8/1984 | Gessalin |
| 4,558,470 | A | 12/1985 | Mitchell |
| 4,586,200 | A | 5/1986 | Poon |
| 4,665,569 | A | 5/1987 | Santini |
| 4,856,119 | A | 8/1989 | Häberle |
| 4,937,888 | A | 7/1990 | Straus |
| 4,996,724 | A | 3/1991 | Dextrase |
| 5,035,009 | A | 7/1991 | Wingo et al. |
| 5,263,203 | A | 11/1993 | Kraemer |
| 5,271,103 | A | 12/1993 | Darnell |
| 5,450,631 | A | 9/1995 | Egger |
| 5,475,878 | A | 12/1995 | Dawn et al. |
| 5,515,546 | A | 5/1996 | Shifrin |
| 5,518,802 | A | 5/1996 | Colvin |
| 5,544,367 | A | 8/1996 | March, II |
| 5,553,330 | A | 9/1996 | Carveth |
| 5,561,866 | A | 10/1996 | Ross |
| 5,661,854 | A | 9/1997 | March, II |
| 5,732,414 | A | 3/1998 | Monica |
| 5,787,513 | A | 8/1998 | Sharmat |
| 5,794,271 | A | 8/1998 | Hastings |
| 5,799,337 | A | 9/1998 | Brown |
| 5,953,761 | A | 8/1999 | Jurga |
| 5,950,243 | A | 9/1999 | Winters et al. |
| 5,956,777 | A | 9/1999 | Popovich |
| 6,088,840 | A | 7/2000 | Im |
| 6,131,196 | A | 10/2000 | Vallion |
| 6,154,889 | A | 12/2000 | Moore, III et al. |
| 6,189,156 | B1 | 2/2001 | Loiars |
| 6,219,850 | B1 | 4/2001 | Halstead et al. |
| 6,272,692 | B1 | 8/2001 | Abraham |
| 6,282,724 | B1 | 9/2001 | Abraham et al. |
| 6,292,952 | B1 | 9/2001 | Watters et al. |
| 6,360,376 | B1 | 3/2002 | Carrington |
| 6,378,140 | B1 | 4/2002 | Abraham et al. |
| D465,067 | S | 10/2002 | Ide |
| 6,658,671 | B1 | 12/2003 | Von Hoist et al. |
| D492,818 | S | 7/2004 | Ide |
| 6,934,971 | B2 | 8/2005 | Ide et al. |
| 7,089,602 | B2 | 8/2006 | Talluri |
| D528,705 | S | 9/2006 | Ide |
| 7,254,843 | B2 | 8/2007 | Talluri |
| 7,328,462 | B1 | 2/2008 | Straus |
| D603,099 | S | 10/2009 | Bologna |
| D603,100 | S | 10/2009 | Bologna |
| 7,673,351 | B2 | 3/2010 | Copeland |
| 7,743,640 | B2 | 6/2010 | Lamp et al. |
| 7,802,320 | B2 | 9/2010 | Morgan |
| 7,832,023 | B2 | 11/2010 | Crisco |
| 7,849,524 | B1 | 12/2010 | Williamson et al. |
| 7,954,177 | B2 | 6/2011 | Ide |
| 3,069,498 | A1 | 12/2011 | Maddux |
| 8,069,498 | B2 | 12/2011 | Maddux |
| 8,176,574 | B2 | 5/2012 | Bryant |
| 8,201,269 | B2 | 6/2012 | Maddux |
| 8,209,784 | B2 | 7/2012 | Nimmons |
| D681,280 | S | 4/2013 | Bologna |
| D681,281 | S | 4/2013 | Bologna |
| 8,499,366 | B2 | 8/2013 | Nimmons |
| 8,528,118 | B2 | 9/2013 | Ide |
| 8,544,117 | B2 | 10/2013 | Erb |
| 8,572,767 | B2 | 11/2013 | Bryant |
| 8,640,267 | B1 | 2/2014 | Cohen |
| 8,661,564 | B2 | 3/2014 | Dodd |
| 8,726,424 | B2 | 5/2014 | Thomas |
| 8,776,272 | B1 | 7/2014 | Straus et al. |
| 8,813,269 | B2 | 8/2014 | Bologna |
| D733,972 | S | 7/2015 | Szalkowski |
| 9,107,466 | B2 | 8/2015 | Hoying |
| 9,131,744 | B2 | 9/2015 | Erb |
| D752,821 | S | 3/2016 | Bologna |
| D752,822 | S | 3/2016 | Bologna |
| D752,823 | S | 3/2016 | Bologna |
| 9,289,024 | B2 | 3/2016 | Withnall |
| 9,314,063 | B2 | 4/2016 | Bologna |
| 9,398,783 | B2 | 7/2016 | Nimmons |
| D764,716 | S | 8/2016 | Bologna |
| 9,498,014 | B2 | 11/2016 | Princip |
| 9,622,532 | B2 | 4/2017 | Tryner |
| 9,622,533 | B2 | 4/2017 | Warmouth |
| D787,748 | S | 5/2017 | Bologna |
| 9,642,410 | B2 | 5/2017 | Grice |
| 9,656,148 | B2 | 5/2017 | Bologna |
| 9,756,891 | B1 | 9/2017 | McGhie et al. |
| 9,763,488 | B2 | 9/2017 | Bologna |
| 9,770,060 | B2 | 9/2017 | Infusino |
| 9,943,746 | B2 | 4/2018 | Nimmons |
| 10,143,256 | B2 | 12/2018 | Straus |
| 10,149,511 | B2 | 12/2018 | Vito |
| 2001/0039674 | A1 | 11/2001 | Shida |
| 2004/0025231 | A1 | 2/2004 | Ide |
| 2004/0045078 | A1 | 3/2004 | Puchalski |
| 2004/0117896 | A1 | 6/2004 | Madey et al. |
| 2004/0261157 | A1 | 12/2004 | Talluri |
| 2005/0241049 | A1 | 11/2005 | Ambuske et al. |
| 2006/0031978 | A1 | 2/2006 | Pierce |
| 2006/0242752 | A1 | 11/2006 | Talluri |
| 2007/0000032 | A1 | 1/2007 | Morgan |

(56) References Cited

U.S. PATENT DOCUMENTS

| | | | |
|---|---|---|---|
| 2007/0151003 | A1 | 7/2007 | Shih |
| 2007/0157370 | A1 | 7/2007 | Joubert des Ouches |
| 2007/0163158 | A1 | 7/2007 | Bentz |
| 2007/0266481 | A1 | 11/2007 | Alexander et al. |
| 2008/0250550 | A1 | 10/2008 | Bologna et al. |
| 2009/0031479 | A1 | 2/2009 | Rush, III |
| 2009/0106882 | A1 | 4/2009 | Nimmons et al. |
| 2009/0260133 | A1 | 10/2009 | Del Rosario |
| 2010/0005573 | A1 | 1/2010 | Rudd et al. |
| 2010/0043126 | A1 | 2/2010 | Morel |
| 2010/0050323 | A1 | 3/2010 | Durocher et al. |
| 2010/0180362 | A1 | 7/2010 | Glogowski et al. |
| 2010/0287687 | A1 | 11/2010 | Ho |
| 2010/0299812 | A1 | 12/2010 | Maddux |
| 2010/0299813 | A1 | 12/2010 | Morgan |
| 2011/0047678 | A1 | 3/2011 | Barth et al. |
| 2011/0209272 | A1 | 9/2011 | Drake |
| 2011/0271428 | A1 | 11/2011 | Withnall et al. |
| 2012/0011639 | A1 | 1/2012 | Beauchamp |
| 2012/0017358 | A1 | 1/2012 | Princip et al. |
| 2012/0066820 | A1 | 3/2012 | Fresco |
| 2012/0079646 | A1 | 4/2012 | Belanger |
| 2012/0151663 | A1 | 6/2012 | Rumbaugh |
| 2012/0198604 | A1 | 8/2012 | Weber et al. |
| 2012/0216339 | A1 | 8/2012 | Nimmons |
| 2012/0233745 | A1 | 9/2012 | Veazie |
| 2012/0317705 | A1 | 12/2012 | Lindsay |
| 2013/0067643 | A1 | 3/2013 | Musal et al. |
| 2013/0185837 | A1 | 7/2013 | Phipps et al. |
| 2013/0014313 | A1 | 10/2013 | Erb |
| 2013/0283504 | A1 | 10/2013 | Harris |
| 2013/0333098 | A1 | 12/2013 | Nimmons |
| 2014/0007322 | A1 | 1/2014 | Marz et al. |
| 2014/0223641 | A1 | 8/2014 | Henderson |
| 2014/0223644 | A1 | 8/2014 | Bologna et al. |
| 2014/0223646 | A1 | 8/2014 | Bologna |
| 2014/0325745 | A1 | 11/2014 | Erb |
| 2015/0082520 | A1 | 3/2015 | Cheng et al. |
| 2015/0157083 | A1 | 6/2015 | Lowe |
| 2015/0230537 | A1 | 8/2015 | Warmouth |
| 2015/0250248 | A1 | 9/2015 | Jacobsen |
| 2015/0335091 | A1 | 11/2015 | Erb et al. |
| 2015/0335092 | A1 | 11/2015 | Erb |
| 2016/0021967 | A1 | 1/2016 | Finiel |
| 2016/0029733 | A1 | 2/2016 | Kovarik et al. |
| 2016/0058093 | A1 | 3/2016 | Kennard |
| 2017/0135433 | A1 | 5/2017 | Booher, Sr. et al. |

OTHER PUBLICATIONS

Riddell, Inc.'s Final Invalidity and Unenforceability Contentions, *Kranos IP Corp. et al.* v. *Riddell, Inc.*, Civ. No. 17-cv-06802 (N.D. III).

Memorandum Opinion and Order in *Kranos IP Corp. et al.* v. *Riddell, Inc.* (E.D. III. Sep. 12, 2018).

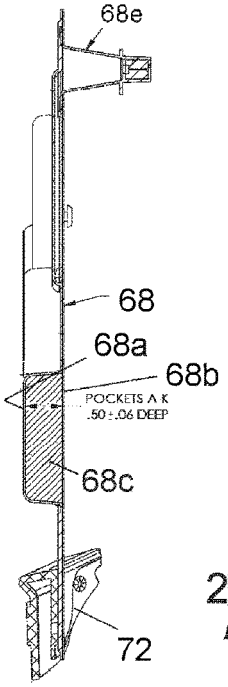
FIG. 22
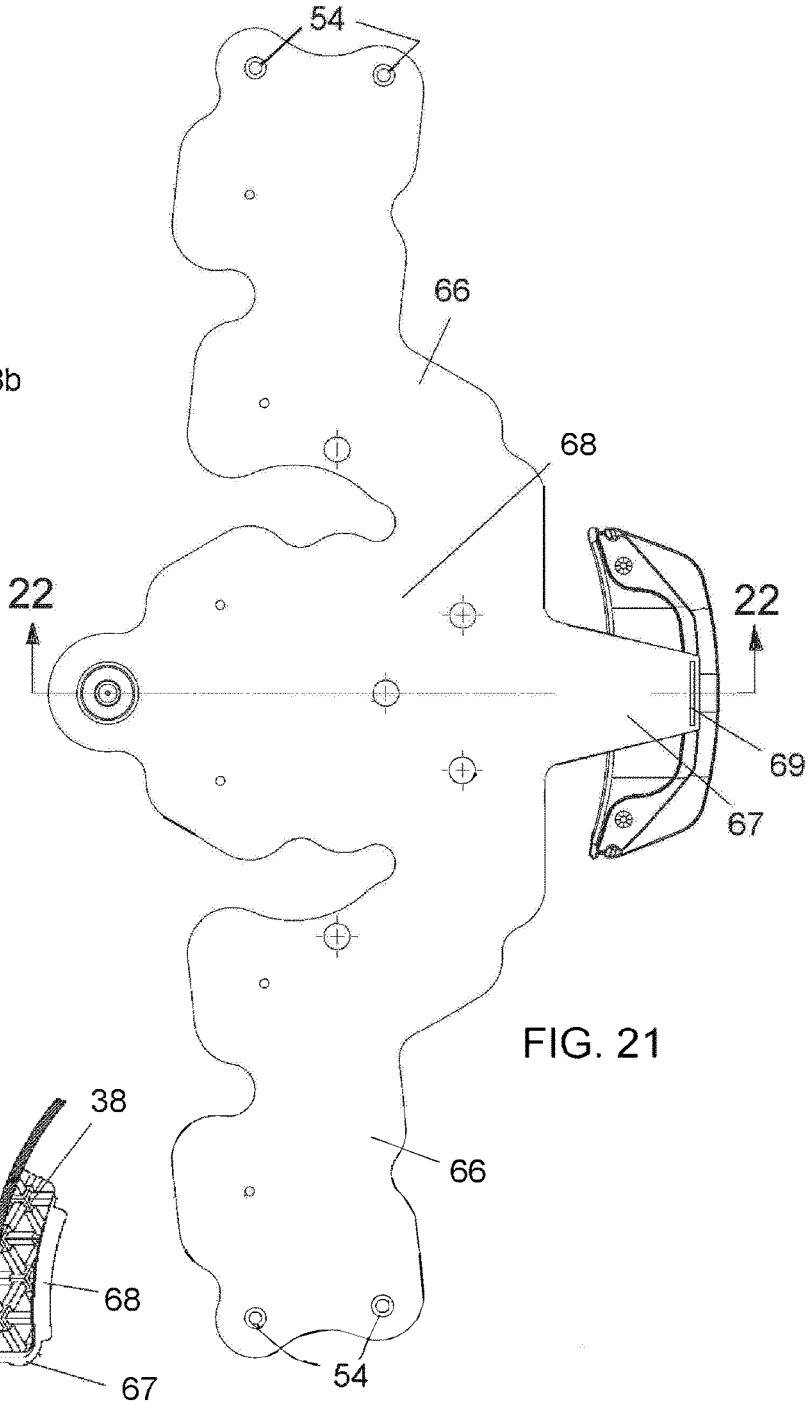
FIG. 21
FIG. 23
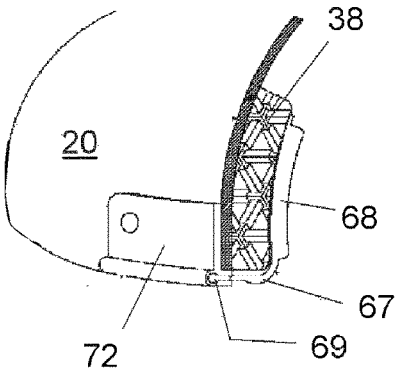

FOOTBALL HELMET WITH RAISED PLATEAU

CROSS-REFERENCE TO RELATED APPLICATIONS

This application is a continuation of U.S. patent application Ser. No. 16/139,951, filed Sep. 24, 2018, which is a continuation of U.S. patent application Ser. No. 15/799,335, filed Oct. 31, 2017, now U.S. Pat. No. 10,098,406, which is a continuation of U.S. patent application Ser. No. 14/815,491, filed Jul. 31, 2015, now U.S. Pat. No. 9,833,033, which is a continuation of U.S. patent application Ser. No. 13/526,077, filed Jun. 18, 2012, now U.S. Pat. No. 9,131,744.

FIELD AND BACKGROUND OF THE INVENTION

The present invention relates generally to the field of protective helmets, and in particular to a new and useful football helmet.

SUMMARY OF THE INVENTION

According to the subject technology, a football helmet has a rigid plastic football helmet shell adapted to cover the head of a wearer. The shell has a raised plateau in the crown portion of the shell extending from the front portion, over the crown portion, toward the back portion. The raised plateau has a left border and a right border. The left border is composed of a plurality of segments and extends continuously from the front portion, over the crown portion, toward the back portion. The segments of the left border including at least a first segment and a second segment, which meet to form an angle. A non-circular first ventilation hole through the shell has at least a first side, a second side, and a third side. The non-circular ventilation hole is positioned at the angle, such that the first side is adjacent to the first segment and the second side is adjacent to the second segment. The first segment extends beyond the first ventilation hole by a first distance at least as long as the first side and the second segment extending beyond the first ventilation hole by a second distance at least as long as the second side.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 21 is an outer surface view of a lateral liner of the comfort liner assembly;

FIG. 22 is a sectional view taken along line 22-22 of FIG. 21, of the lateral liner; and FIG. 23 is a detail view of the connection between the lateral liner and a back bumper of the helmet.

DESCRIPTION OF THE PREFERRED EMBODIMENTS

Figure 1:
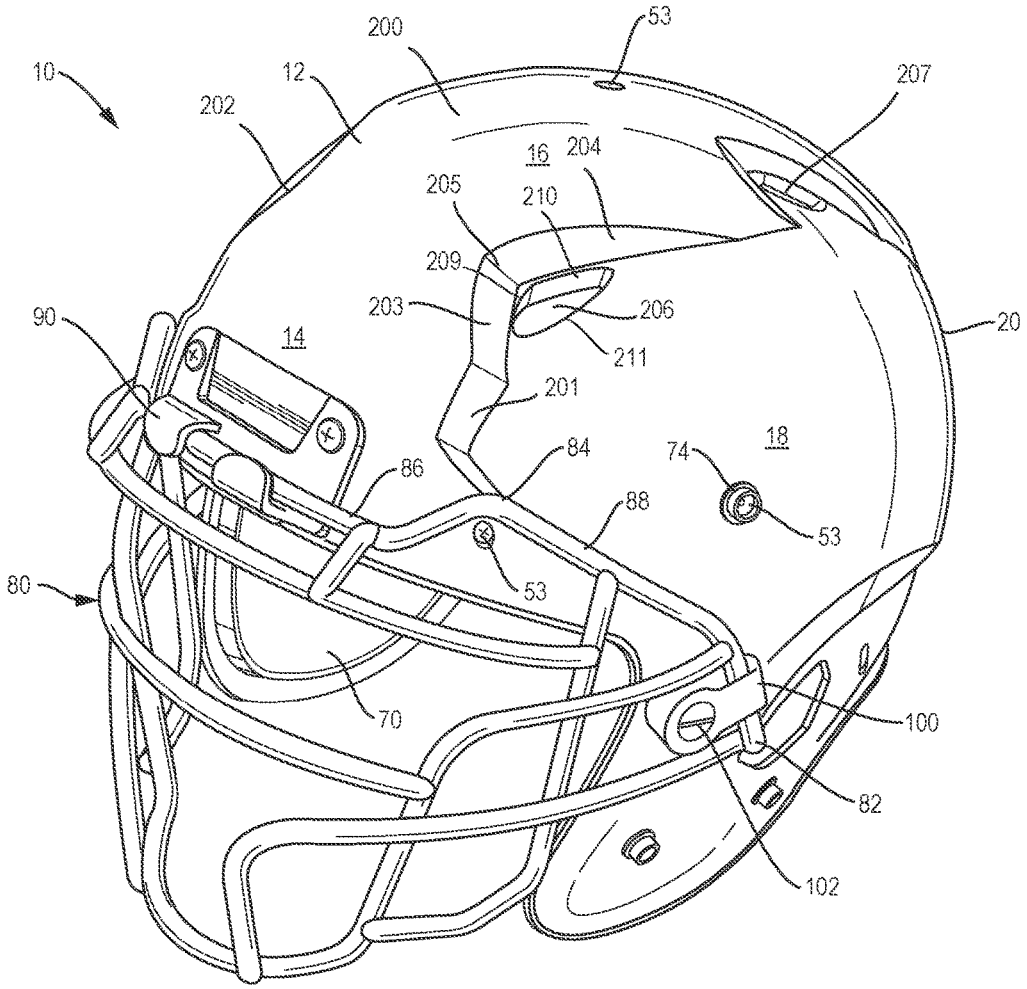
FIG. 1 is a perspective view of a football helmet according to the subject technology.
Figure 2:
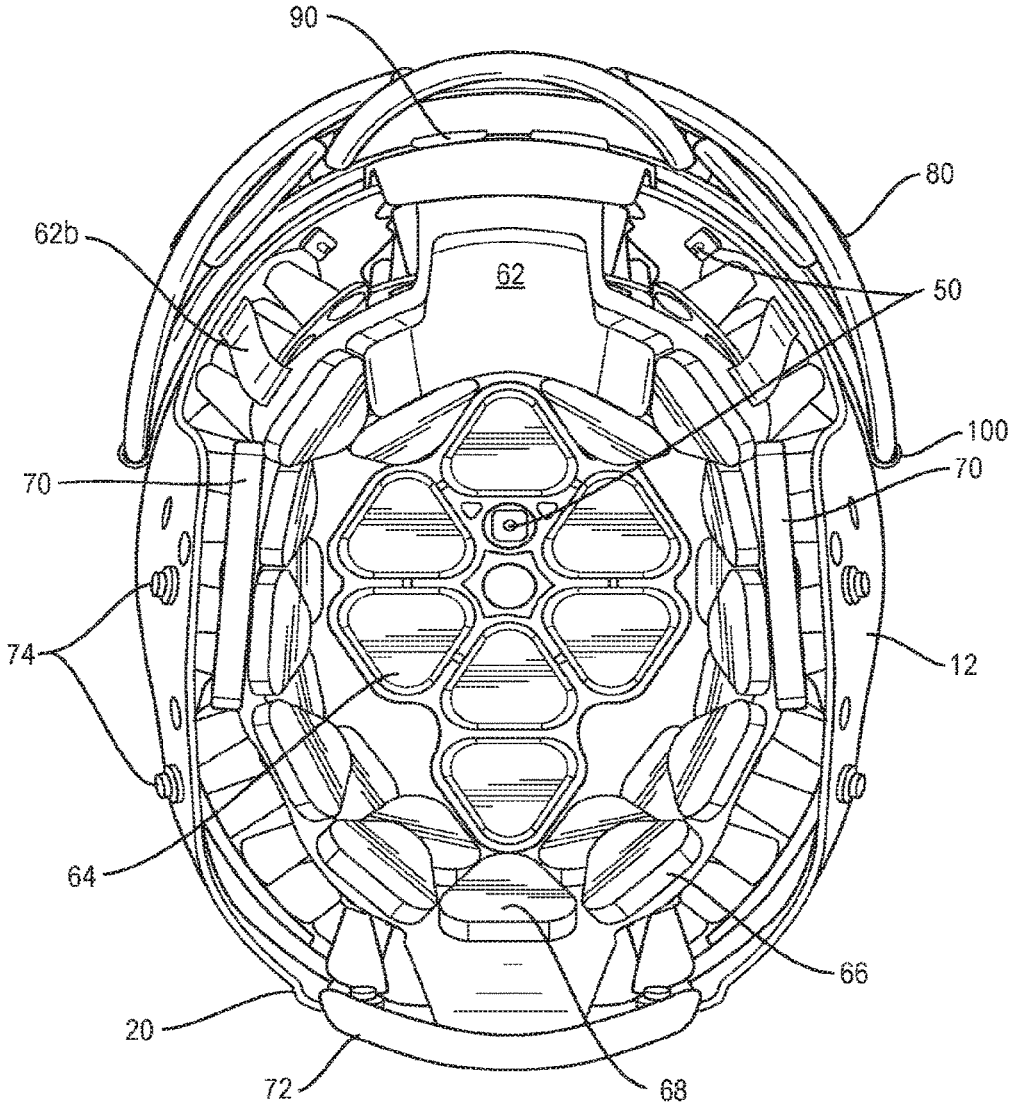
FIG. 2 is a bottom plan view of the helmet.
Figure 3:
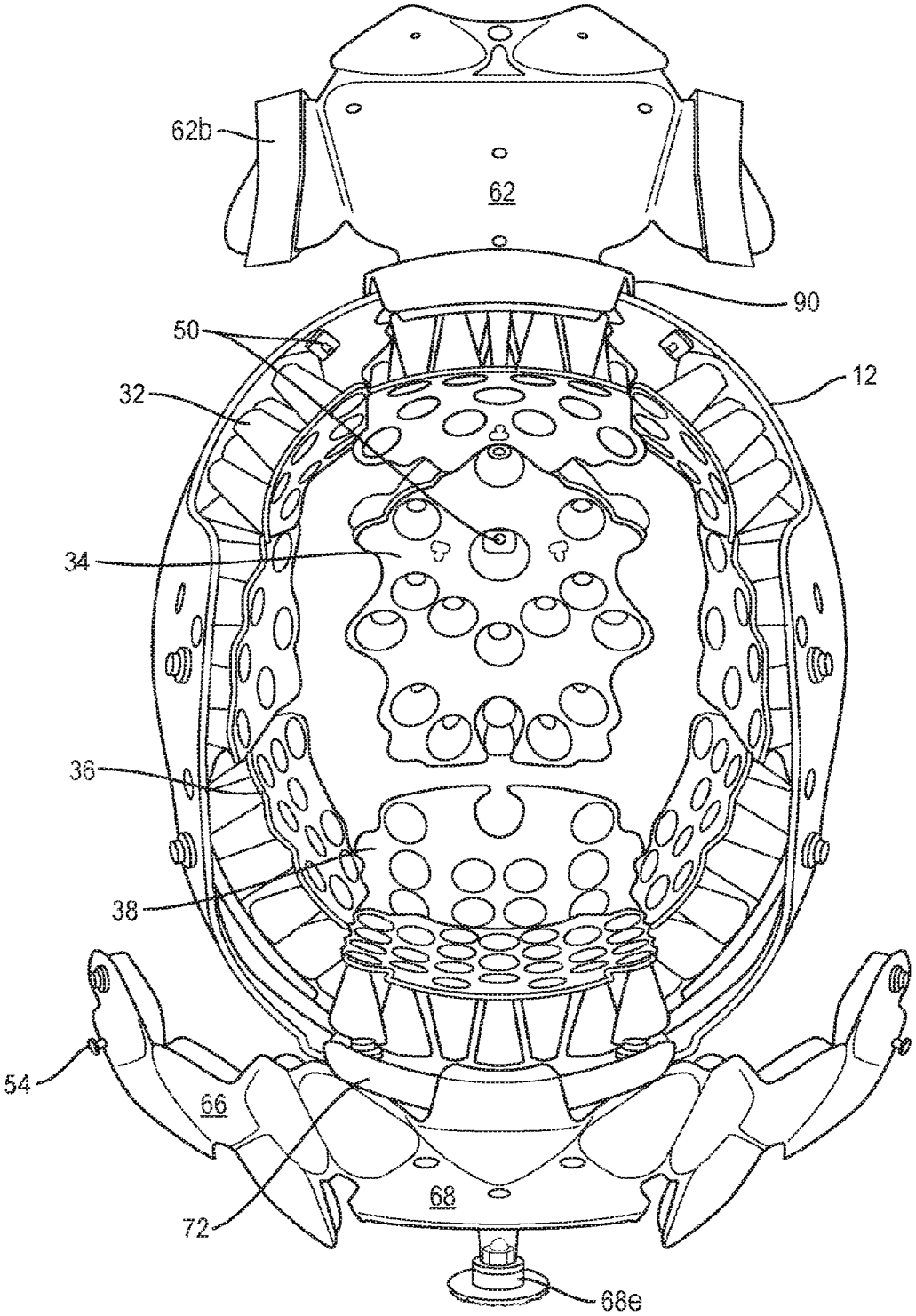
FIG. 3 is a view similar to FIG. 2, but with a comfort liner assembly peeled away to reveal a padding system of the helmet.

Referring now to the drawings, in which like reference numerals are used to refer to the same or similar elements, FIG. 1 shows a football helmet 10 comprising a rigid shell 12 adapted to cover the head of a wearer, the rigid shell having an outer surface and an inner surface, the inner surface having selected concave curvatures at various portions of the shell as can be better appreciated from FIGS. 2 and 3. Returning to FIG. 1, the shell 12 has a front portion 14 for covering the forehead of the wearer, a crown portion 16 for cover the top of the wearer's head, a pair of opposite side portions 18 for covering the sides of the wearer's head, and a back portion 20 for covering the back of the wearer's head.

As seen in FIG. 1, shell 12 has a single raised plateau 200 in the crown portion of the shell extending from the front portion, over the crown portion, toward the back portion. Raised plateau 200 has a left border 201 and a right border 202. As seen in FIG. 1, this raised plateau is the only raised plateau of the shell which begins in the front portion, extends over the crown portion, and ends in the back portion. Left border 201 is composed of a plurality of segments and extends continuously from the front portion, over the crown portion, toward the back portion. The segments of left border 201 include first segment 203 and second segment 204, which meet to form an angle 205. Non-circular ventilation hole 206 through the shell has at least a first side 209, a second side 210, and a third side 211. Ventilation hole 206 is positioned at angle 205, such that the first side 209 is adjacent to the first segment 203 and the second side 210 is adjacent to the second segment 204. As seen in FIG. 1, the first segment 203 extends beyond the ventilation hole 206 by a first distance at least as long as the first side 209 and the second segment 204 extending beyond ventilation hole 206 by a second distance at least as long as the second side 210. That is, first segment 203 has a length at least twice as long as the length of first side 209 of hole 206, and second segment 204 has a length at least twice as long as the length of the second side 210 of hole 206. A second non-circular ventilation hole 207 is adjacent to left border 201.

As shown in FIGS. 3, 4 and 6-10, a padding system is removably attached to the inner surface of the rigid shell 12 and comprises a plurality of impact absorbing pads that are spaced apart on the inner surface of the shell and that conform to the inner concave curvatures at the various portions of the shell. The padding system comprises a front pad 32 that is removably attached at the front portion 14 of the shell, a crown pad 34 that is removably attached at the crown portion 16 of the shell, a pair of side pads 36 removably attached at the respective side portions 18 of the shell, and a back pad 38 removably attached at the back portion 20 of the shell.

As shown in FIG. 1, the padding system also includes a pair of jaw pads 70 connected to the inner surface of the side portions 18 of shell 12 by snaps and as disclosed in published U.S. patent application US 2011/0131695. Published patent application US 2011/0131695 is incorporated herein by reference for its teaching of protective jaw pads for a helmet shell.

Figure 7:
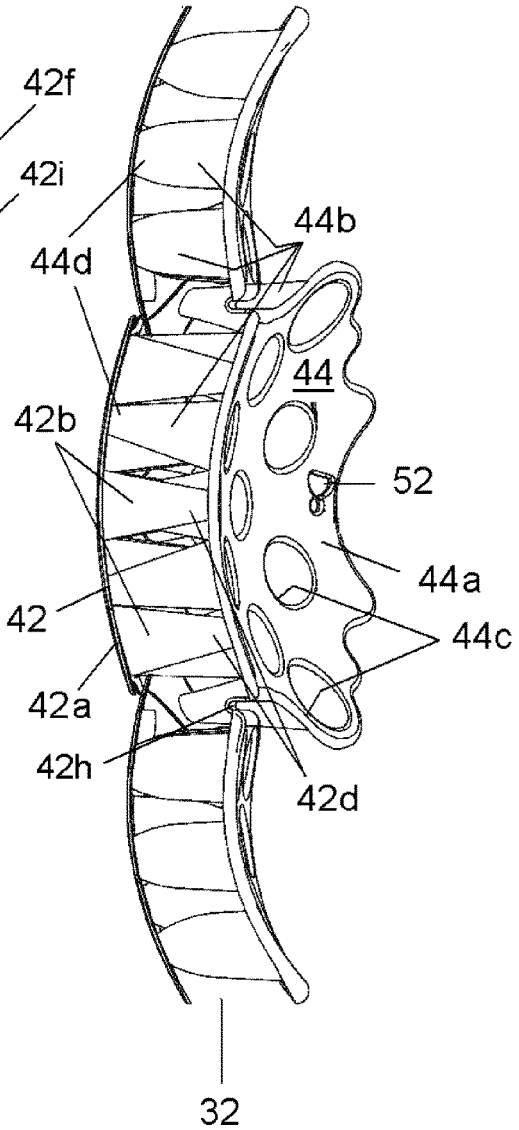
FIG. 7 is a bottom edge view of the front pad.
Figure 9:
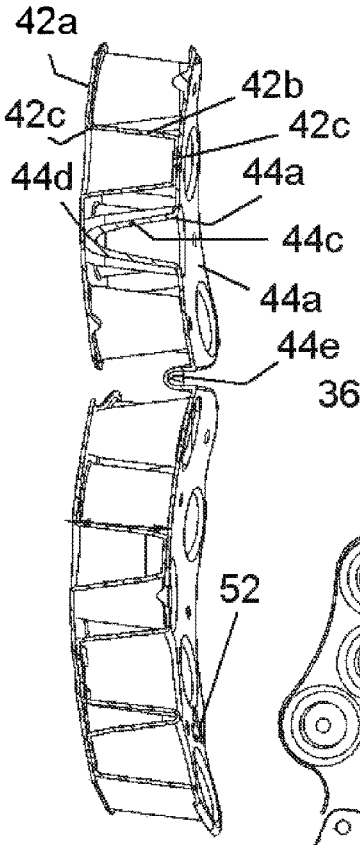
FIG. 9 is a side sectional view of the back pad taken along line 9-9 of FIG. 8.
Figure 8:
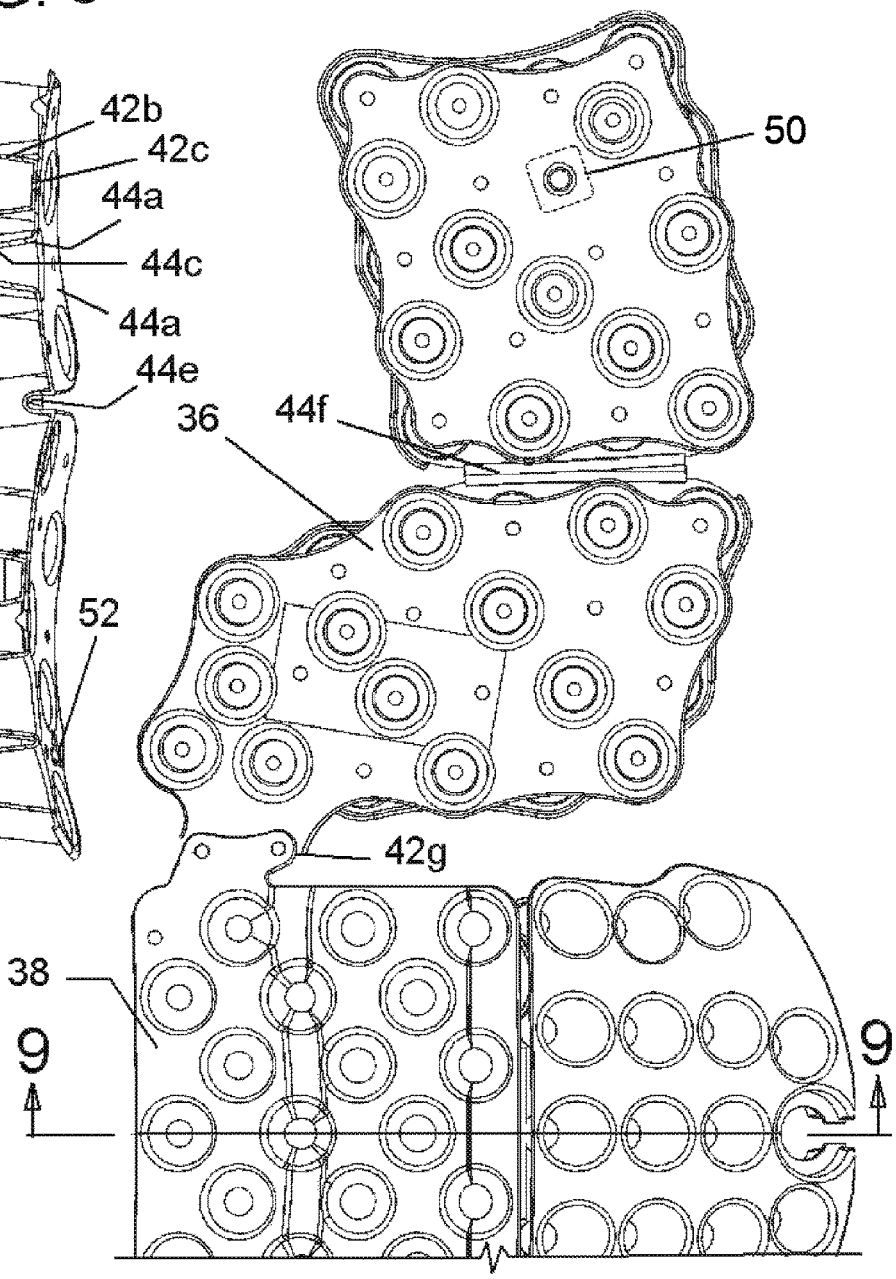
FIG. 8 is a partial plan view of the outer surfaces of a back and one side pad of the padding system.

As best shown in FIGS. 7 and 9, each pad has at least one portion made of two parts of molded thermoplastic urethane (TPU) that are bonded together and that comprise an outer part 42 made of thermoplastic urethane of a first durometer and comprising an outer sheet 42*a* having the selected curvature of the rigid shell adjacent the portion of the inner surface at which the pad is removably attached, and an inner part 44 made of thermoplastic urethane of a second durometer that is the same as the first durometer of the front pad 32, but that is harder than the first durometer of the outer pad, for the crown pad 34, back pad 38 and side pads 36. For all the pads and as also explained in U.S. Pat. No. 8,069,498, the inner part 44 comprises an inner sheet 44*a* that is substantially parallel to and spaced inwardly from the outer sheet 42*a* to define a space between the inner and outer sheets that is open around a perimeter of the inner and outer sheets for each pad. Each of the inner and outer sheets 44*a*, 42*a*, have a plurality of spaced apart, hollow protrusions 44*b* and 42*b* extending to the other sheet, the protrusions of one sheet alternating with the protrusions of the other sheet to form an impact absorbing pattern of alternating protrusions in the space between the sheets.

Each protrusion 42*b*, 44*b* has an open, larger diameter base 42*c* and 44*c* at the sheet from which it extends, a smaller diameter peak 42*d* and 44*d*, and a side wall that tapers from the base to the peak for each protrusion, each base, side wall and peak being molded of one piece of TPU with the sheet from which they extend, and each peak being fused, as best shown in FIG. 9, to the sheet of the other part of the pad. Upon an impact on the outer surface of the rigid shell 12 and a resulting relative movement of the helmet with respect to the head of the wearer, the small diameter peaks of the outer part of the pads in the crown, back and side areas of the impact, having the first lower durometer peaks nearer the wearer's head, collapse more easily than the peaks of the inner part of the pad nearer the shell and nearer the area of impact, to dissipate the impact with reduced pressure on the head of the wearer.

The first durometer of the various outer TPU parts of the various pads is between about 80 and 95 Shore-A and the second durometer of the various inner TPU parts is between about 90 and 95 Shore-A. For the back (38), both sides (36) and crown (34) pads, the inner parts have a second durometer that is from between about 5 to 10 Shore-A harder than the first durometer of the outer parts so that the small peaks of the outer part protrusions are softer toward the wearer's head. For the central and both side portions 32*a* of the front pad 32, both the first and second durometer are about equal at about 95 Shore A for maximum protection at this front area of the helmet were impacts are most often expected to occur. This harder frontal durometer value is also reflected in the harder foam used in the comfort liner assembly at this location as will be explained later. The side portions 32*a* of the front pad 32 are connected to the central portion thereof by flexible extension 42*h* of the inner sheets 42 thereof, as shown in FIG. 7.

The first durometer of the outer part of the back pad 38 is advantageously about 80 Shore A with the second durometer of the inner part thereof being about 85 Shore A. Back pad 38 has bottom and top portions that are connected to each other by a flexible extension 44*e* of their inner sheets 44*a* shown in FIG. 9. The back pad 38 is also connected to each of the side pads 36 by fused together extensions 42*g* of the outer sheets 42*a* of each of these pads and each side pad 36 has rear and front portions connect to each other by a flexible extension 44*f* of the inner sheet 44*a* of these pads. For both portions of the side pads 36, the first durometer of the outer part is about 80 Shore A and the second durometer of the inner part is about 85 Shore A.

The first durometer of the outer part of the crown pad 34 is advantageously about 85 Shore A with the second durometer of the inner part thereof being about 90 Shore A. Here, as with the back and side pads, the softer outer protrusions are used but, for better protection, overall harder padding is used at the crown then at the back and sides. The overall crown pad harness is also less than the front pads, again to optimize impact protection where and as it is needed.

Figure 10:
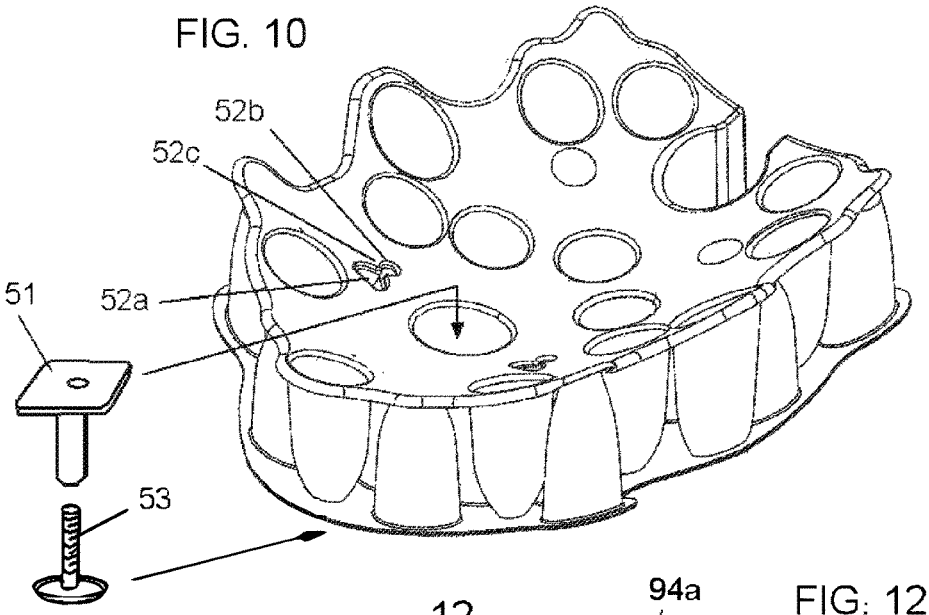
FIG. 10 is an inner front perspective view of a crown pad of the padding system.
Figure 11:
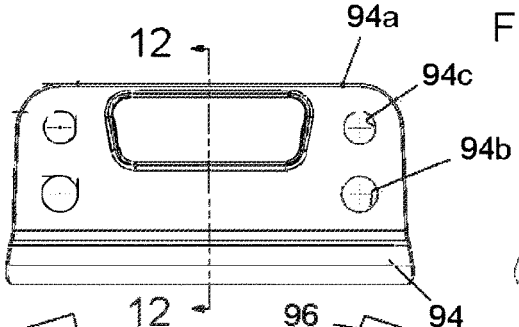
FIG. 11 front elevational view of a nameplate holder of a front or nose bumper of the helmet.
Figure 12:
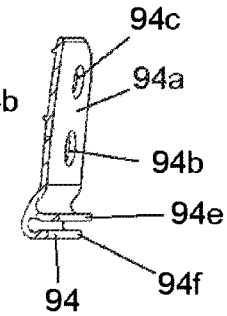
FIG. 12 is a sectional view taken along line 12-12 of FIG. 11.
Figure 13:
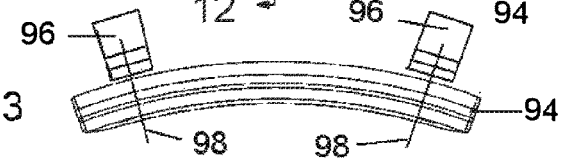
FIG. 13 is a top plan view of the nameplate holder plus loopstraps to be used with the nameplate holder for connecting a faceguard to the helmet shell.
Figure 16:
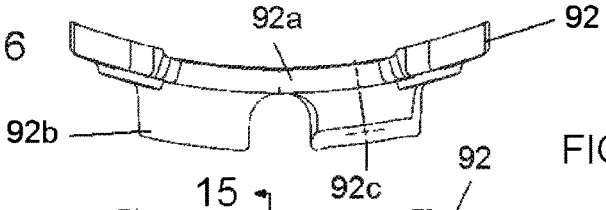
FIG. 16 is a top plan view of the quick release retainer.
Figure 14:
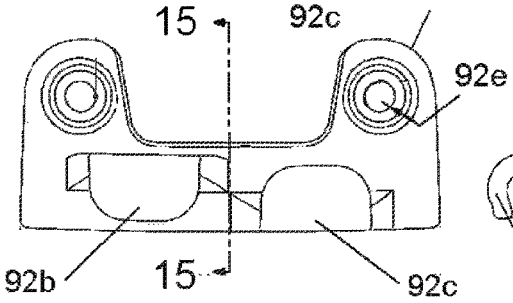
FIG. 14 is a front elevational view of a quick release, twist-off retainer of the nose bumper of the helmet.

Some of the pads of the padding system are removably attached to the inside surface of shell by mechanical fasteners 50 extending through the shell 12, such as T-nuts shown for example in FIG. 10, having flange nut 51 with a threaded tube for engaging a hole in the pad and for extending through a hole in the shell, and a threaded screw 53, threaded to the threaded tube and extending from an outer surface of the shell. The head of a screw 53 for connecting the crown pad 34 is visible at the top of the helmet shell in FIG. 1. Another screw 53 extending in a snap fastener 7 for removably connecting a chin guard strap to the shell is also visible in FIG. 1 and is for a T-nut 50 that connects one of the side pads 36 to the shell. In this way the same hole that is needed to the chin strap snap 74 is also used for the T-nut for the pad mounting.

Figure 6:
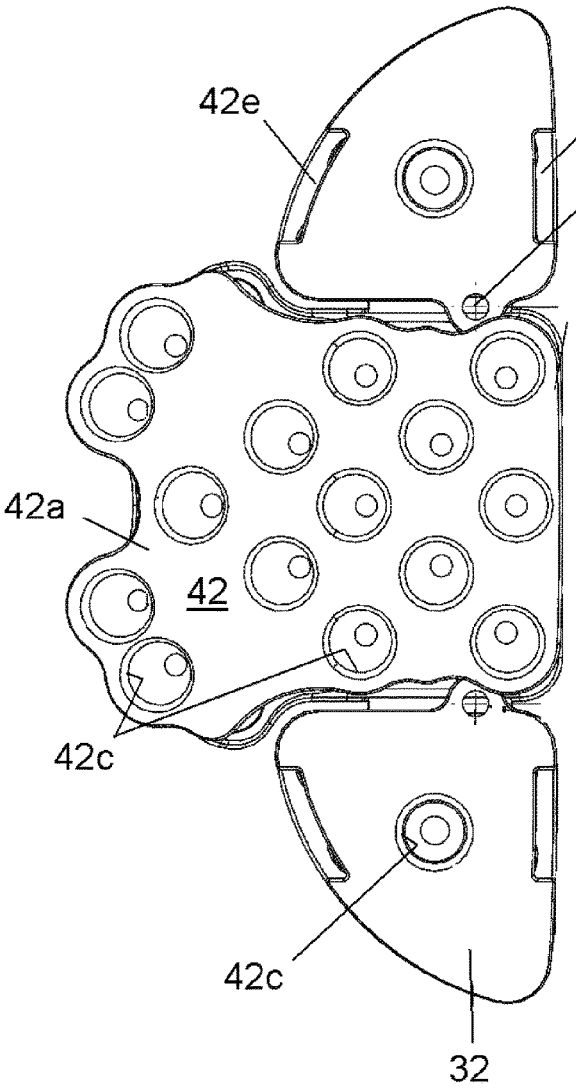
FIG. 6 is a plan view of the outer surfaces of a front pad of the padding system.

A further pair of screws 53 at the front portion 14 of the shell 12 under the upper parts of a faceguard 80 as seen in FIG. 1, are threaded to flange nuts 51 extending through holes 42*i* in the outer sheets 42*a* of the side portions 32*a* of the front pad 32 as shown in FIG. 6, for removably connecting the front pad into the front portion of the helmet shell.

At least some of the pads have inner sheet 44*a* with one or more keyholes 52 therein, each keyhole, as best shown in FIG. 10, having a large diameter, semicircular portion 52*a*, a small diameter circular portion 52*b* communicating with the large diameter portion, and a curved, hour-glass shaped constricted passage 52*c* between the large and small diameter portions that is smaller than the small diameter portion so that the keyhole is generally bell shaped. These keyholes 52 are for removably receiving resilient buttons and stems on the outer surfaces of the liners as will be explained later, for removably connecting the liners to the padding system in an improved manner.

Referring now to FIGS. 2, 5 and 17-23, the helmet includes a comfort liner assembly that is removably attached to inner surfaces of the inner sheets of the pads of the padding system. The comfort liner assembly comprises a front liner 62 at an inner surface of the front pad 32, a crown liner 64 at an inner surface of crown pad 34, and a lateral liner comprising a pair of side cushion assemblies 66 at inner surfaces of the respective pair of side pads 36, and a back cushion assembly 68 at an inner surface of the a back pad 38.

Figure 4:
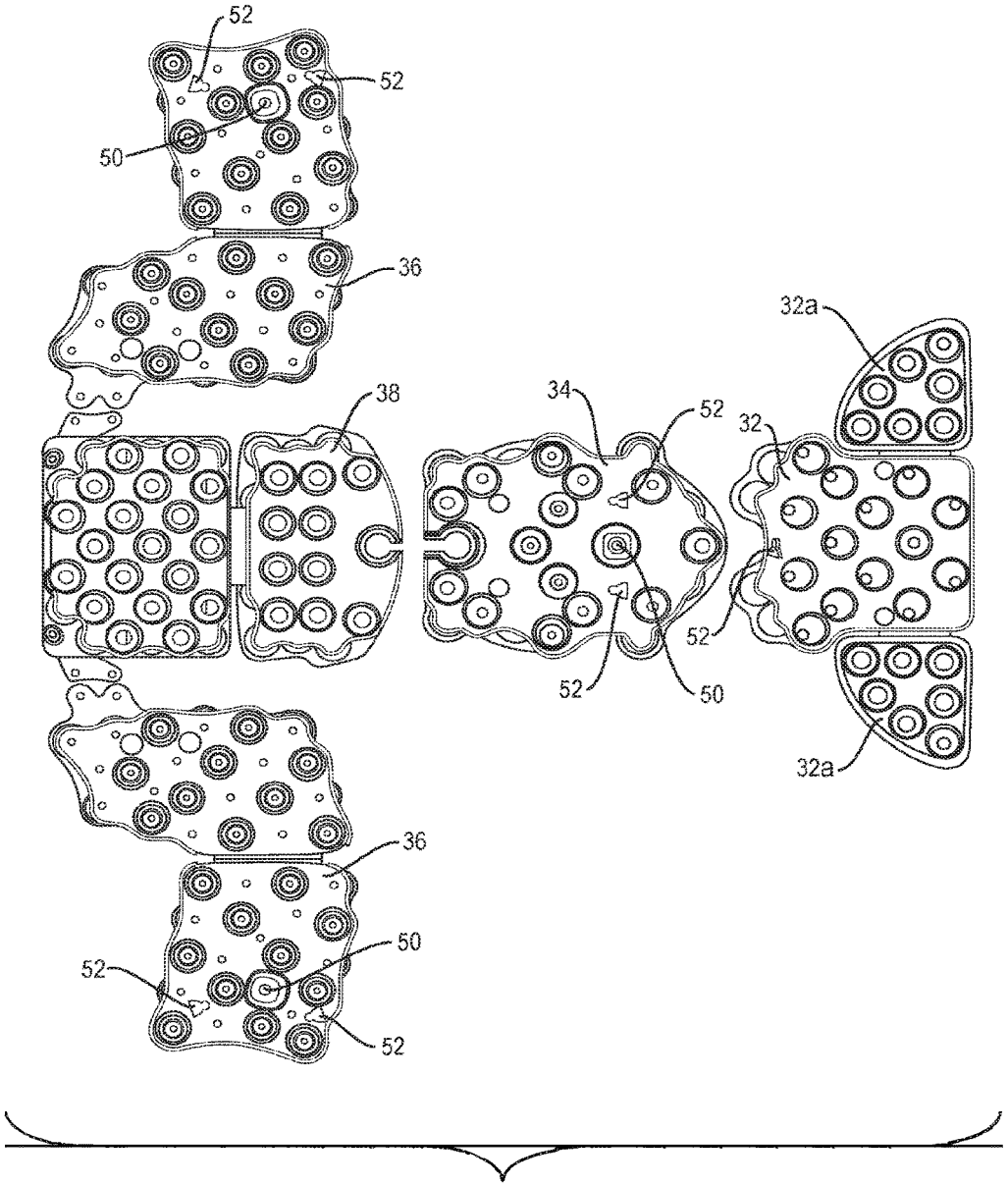
FIG. 4 is a plan view of the padding system laid out and with the inner surfaces showing for easier understanding.

The liners that are over at least some of the pads have one or more resilient buttons 54 each with a resilient stem 56, formed with or fused to an outer plastic sheet of the liners, for engaging each respective keyhole 52, each button having a diameter for being received in a respective large diameter portion 52*a* of a keyhole and each stem having a diameter that is larger than the constricted passage 52*c* and of a size for being received in a respective small diameter portion 52*b* of a respective keyhole 52, so that each button is removably trapped at a respective keyhole. A shown, in FIG. 18, front liner 62 has one button 54, in FIG. 20 crown liner 64 is shown to have two buttons 54 and as shown in FIG. 21, lateral liner 66, 68 has four buttons 54. Corresponding keyholes 52 or in the front, crown, and side pads as shown in FIG. 4.

Figure 18:
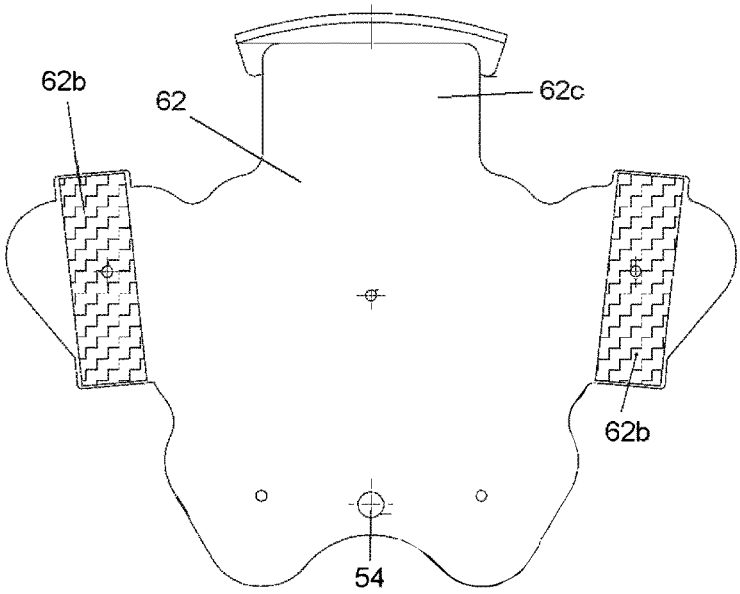
FIG. 18 is an outer surface view of the front liner.
Figure 19:
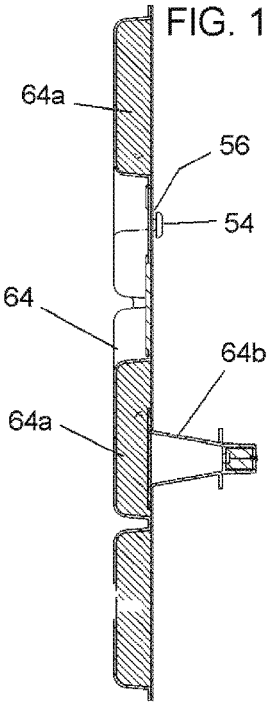
FIG. 19 is a sectional view of a crown liner of the comfort liner assembly.
Figure 20:
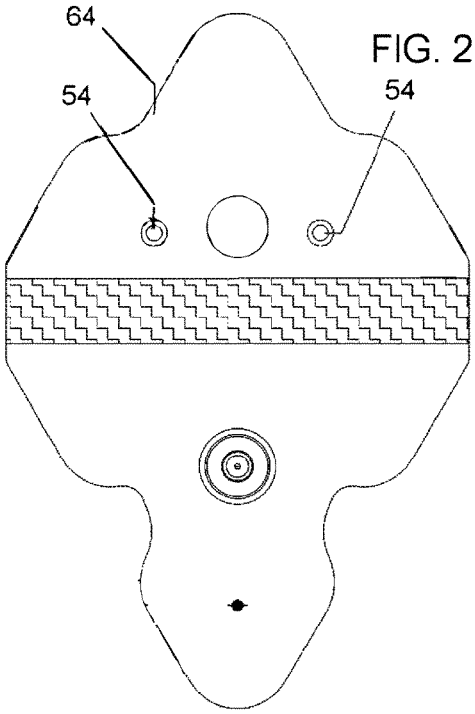
FIG. 20 is an outer surface view of the crown liner.

To help further connected the front liner 62 to and over the front pad 32, and as shown in FIG. 18, a pair of elastic strapping or bands 62*b* are fixed at opposite sides to the front liner 62 and engage around the side parts 32*a* of the front pad 32 for removable connecting the front liner to the front pad, the outer sheets 42*a* of the sides parts 32*a* of the front pad 32, as shown in FIG. 6, each having a pair of opposite notches 42*e* and 42*f* for trapping the elastic band to keep the front liner firming held to and centered on the front pad 32.

Figure 5:
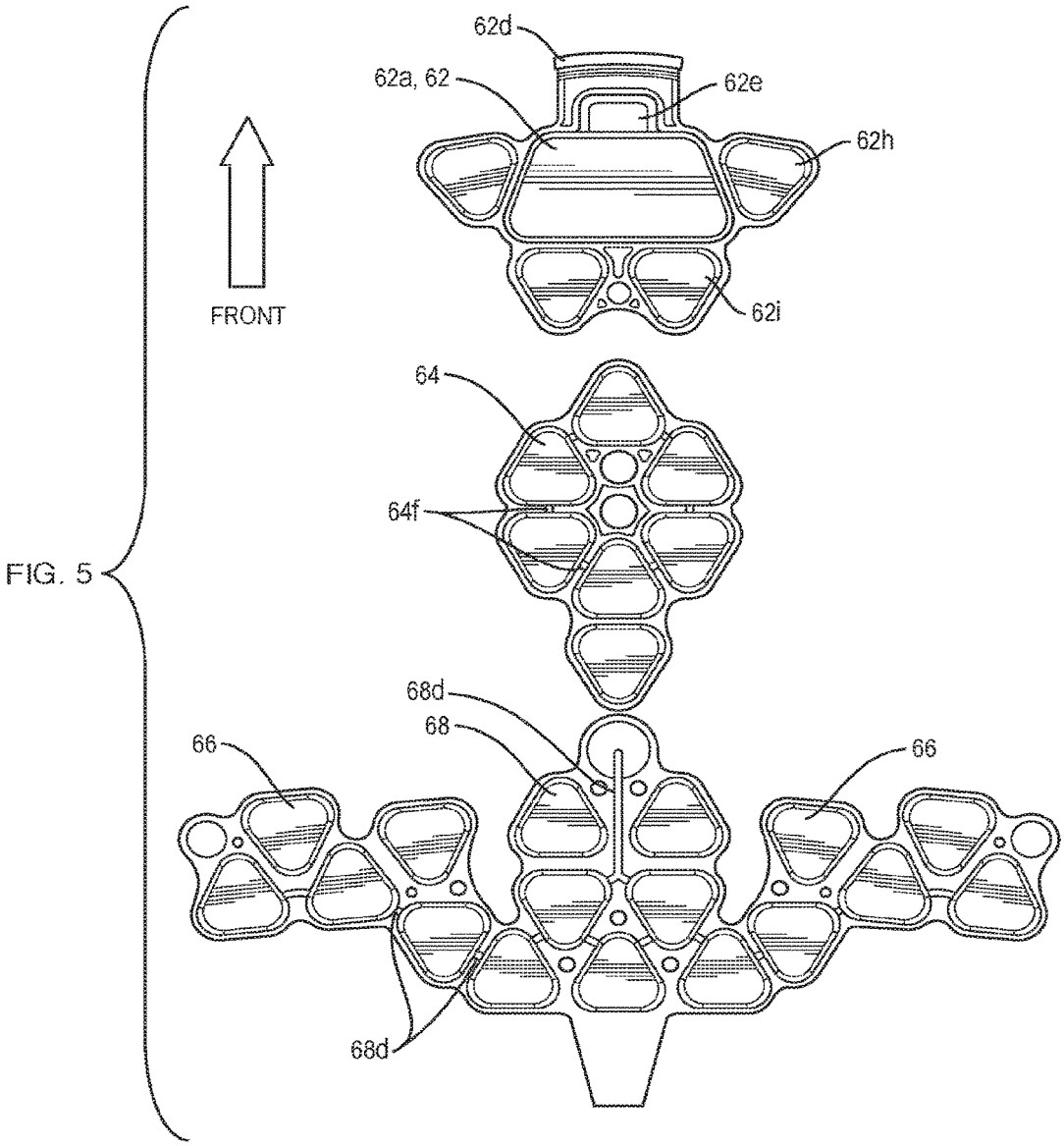
FIG. 5 is a plan view of the comfort liner assembly laid out and with the inner surfaces showing for easier understanding.

Each of the liners comprises inner and outer plastic sheets 68*a*, 68*b* make of thin (e.g. 0.02 to 0.04 inches) TPU sheets (see FIGS. 17 and 22) that are sealed to each other around their perimeter and elsewhere to form a plurality of pockets containing a plurality of triangular foam members as shown in FIG. 5 and at 68*c* in FIG. 22. The front liner 62 also comprises a quadrangular foam member 62*a* in FIG. 17. The crown liner 64 comprises six triangular foam members 64*a* around a center of the liner and a further triangular member at the back. The pair of side cushion assemblies 66 each comprise five staggered triangular foam members, and the back cushion assembly 68 comprises seven more triangular foam members all, spaced about the back and sides of the padding system for providing comfortable support for the wearer's head.

The back cushion assembly 68 (FIG. 21) also includes an extension of the inner and outer plastic sheets forming a ribbon connector 67 having a bead 69 near its end. The helmet includes a back bumper 72 for receiving and holding the bead, the back bumper 72 having a slot so as to be removably engaged over a lower central edge of the back portion 20 of the shell as also shown in FIG. 23, for holding the back cushion assembly 68 against the back pad 38.

The front liner 62 as shown in FIG. 5, has the one quadrangular foam member 62*a* at its center and a pair of triangular members 62*h* at either side as well as a further pair of triangular members 62*i* above the quadrangular foam member 62*a*. The foam members 62*a* and 62*h* that are positioned to engage the forehead of the wearer, are made of a harder foam then the other foam members 62*i* of front liner 62 and of all other the foam members of the crown and the lateral liners 64 and 66, 68. In the preferred embodiment this harder foam is PORON® brand microcellular urethane sold by Rogers Corporation and having a harness between about 15 and 21 Shore "0" durometer or preferably 18 Shore "0" durometer. The other softer triangular foam members of the front, crown and the lateral liners are made of polyether polyurethane with 25% compression of 2 psi and Shore "0" durometer of 3 to 10 less than the PORON® brand microcellular urethane.

The liners also comprise at least one relatively thin foam member 62*e* between the inner and outer plastic sheets 62*f*, 62*g* and under the relatively thick members 62*a* in some of the pockets that is make of the softer foam.

The football helmet as shown in FIGS. 1 and 2, also includes a faceguard 80 comprising cage of polymer coated metal bars having a pair of side bar parts 82 connected by side loopstrap connectors 100 to respective side portions 18 of the shell, and an upper portion 84 having a center bar part 86 connected by a nose bumper 90 to the front portion 14 of the shell, the upper portion of the faceguard including a pair of side bar parts 88 that are each bent upwardly with respect to the center bar part 86 by at least a multiple of a diameter of the center bar part, for example, a multiple of the ¼ inch diameter of the bars, for example by about 1 inch or by about ½ to 1½ inches above the center bar part 86. The side bar parts then extend or are bent downwardly, toward each respective side bar part 82, to create a raised eyebrow area on either side of the front portion 14 of the rigid shell 12, to even better dissipate impacts at the front portion of the shell.

Each side connector 100 comprises a loopstrap connector engaging around a respective one of the side bar parts 82 and a mechanical fastener 102 for removably connecting the loop connector to the side portion of the shell, such as a T-nut or the partial turn connector of published U.S. patent application US 2011/0214224.

Figure 15:
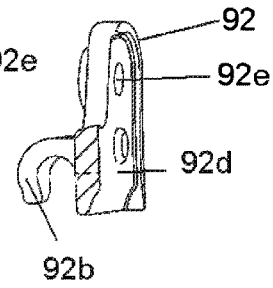
FIG. 15 is a sectional view taken along line 15-15 of FIG. 14.
Figure 17:
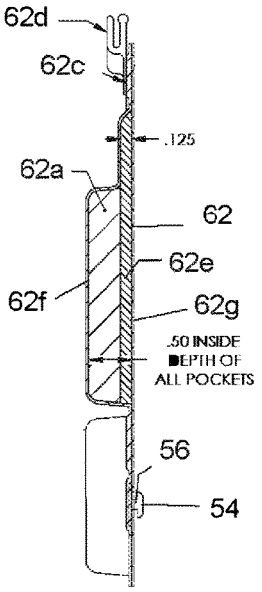
FIG. 17 is a sectional view of a front liner of the comfort liner assembly.

With reference to FIGS. 11-16, the nose bumper 90 includes a quick release retainer 92 having a base 92*a* and a pair of spaced retention arms 92*b* and 92*c* operating as disclosed in U.S. Pat. No. 8,146,178 for engaging above and below the center bar part 86 to hold the center bar part to the shell. The base 92*a* has a rear recess 92*d* as shown in FIG. 15. A nameplate holder 94 of FIGS. 11-13 has a base 94*a* fitting in the recess 92*d* and a pair of openings 94*b* for receiving fasteners for loop connectors 96 for replacing the quick release retainer 92 for holding the center bar part 86 to the shell, e.g. when an eye shield is to be attached to the faceguard 80. To this end the two screws that hold the nose bumper 90 to the shell and that are visible in FIG. 1. are removed and the quick release retainer 92 is removed. This leaves the nameplate holder 94 that is retained at the front portion 14 of the helmet shell by the two screws in two of its holes, and has two more holes or can use the same two holes and to connect loopstraps 96 to the shell for holding the upper center bar part 86 of faceguard 80 to shell 12.

The front liner 62 of the comfort liner assembly also cooperates with the nose bumper 90 to hold the front liner against the front pad 32 of the padding system. To this end the front liner 62 includes an extension of the inner and outer plastic sheets forming a ribbon connector 62*c* in FIGS. 17 and 18 having a fork 62*d* near its end, the nameplate holder 94 having base hook engagement portions 94*e* and 94*f* for removably connecting to the fork 62*d* of the front liner for holding the front liner over the front pad 32.

The sealed plastic sheets 62*f*, 62*g* for creating the pockets of the crown and lateral liners 64, 66, 68, can be inflated with air via inflating fittings 64*b* and 68*e* connected to the outer sheets of the crown liner 64 and the lateral liner 66, 68 for adding air into at least some of the pockets of the crown and lateral liners for creating a closer fit for the comfort liner assembly and the wearer's head. To this end and as shown in FIG. 5, the inner and outer sheets of plastic are sealed around and between the pockets as well, except in the areas of air channels 64*f* and 68*d* in the crown and lateral liners there air can be channeled from the pocket that is directly connected to the fittings 64*b* and 68*e*, to at least some of the other pockets in each of these liners.

The inflating fittings 64*b* and 68*e* extend in circular recesses in the upper edge of the back pad 38 and in the back edge of the crown pad 34 seen in FIG. 4, and are held by hoop-and-loop rings to the inner surface of the helmet shell. Two holes through the shell, to the rear of the upper screw 53 in FIG. 1 for holding the crown pad to the shell, permit a inflating pin to have access to the inflating fittings for inflating the crown and later liners after the wearer have put the helmet one, for a close and comfortable custom fitting of the helmet to the wearer's head.

While a specific embodiment of the invention has been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention. Thus, all the features of all the embodiments disclosed herein are interchangeable so that any element of any embodiment may be applied to any of the embodiments taught herein.

What is claimed is:

1. A plastic football helmet shell, the shell comprising:

a front portion, a back portion, and a crown portion;

a raised plateau beginning in the front portion, extending from the front portion over the crown portion, and ending in the back portion, said raised plateau being the only raised plateau of the shell which begins in the front portion, extends over the crown portion, and ends in the back portion;

the raised plateau having a left border and a right border, the left border being composed of a plurality of segments, the left border running continuously from the front portion, over the crown portion and toward the back portion, wherein said plurality of segments includes at least a first segment and a second segment meeting to form an angle;

a non-circular first ventilation hole, the first ventilation hole having at least a first side and a second side;

the first ventilation hole positioned at the angle, the first side of the first ventilation hole adjacent to the first segment, and the second side of the first ventilation hole adjacent to the second segment;

the first segment and second segment extending beyond the first ventilation hole;

the first segment having a length at least twice as long as a length of the first side of the first ventilation hole; and the second segment having a length at least twice as long as a length of the second side of the first ventilation hole.

2. The football helmet shell of claim 1 further comprising:

a left earflap in a left side portion of the shell and a right earflap in a right side portion of the shell; and a non-circular earhole in the left earflap.

3. The football helmet shell of claim 2, the non-circular earhole being defined by at least four sides.

4. The football helmet shell of claim 1 further comprising a second ventilation hole adjacent to the left border.

5. The football helmet shell of claim 1 further comprising a non-circular second ventilation hole adjacent to the left border.

6. A football helmet comprising a shell according to claim 1, the shell defining a face opening having upper corners; and a faceguard attached to the shell adjacent to the upper corners.

7. The football helmet of claim 6 further comprising a front pad removably attached at the front portion of the shell, a crown pad removably attached at the crown portion of the shell, a pair of side pads removably attached at respective side portions of the shell, and a back pad removably attached at the back portion of the shell.

8. A football helmet for protecting the head of a wearer, the helmet comprising:

a plastic football helmet shell, the shell comprising:

a front portion defining a face opening having upper corners, a crown portion, a left side portion having a left earflap, a right side portion having a right earflap, and a back portion;

a raised plateau having a left border and a right border and beginning in the front portion, extending from the front portion over the crown portion, and ending in the back portion, said raised plateau being the only raised plateau of the shell which begins in the front portion, extends over the crown portion, and ends in the back portion;

the left border of the raised plateau running continuously from the front portion, through the crown portion, toward the back portion, the left border being composed of a plurality of segments, including at least a first segment and a second segment, said first segment and second segment meeting to form an angle;

a non-circular first ventilation hole that is defined by at least a first side and a second side, and is positioned at the angle such that the first side is adjacent to the first segment and the second side is adjacent to the second segment, provided that the first segment extends beyond the first ventilation hole by a first distance at least as long as the first side and the second segment extends beyond the first ventilation hole by a second distance at least as long as the second side;

a non-circular second ventilation hole adjacent to the left border; and a non-circular earhole in the left earflap;

and a faceguard attached to the football helmet shell by connectors, the connectors connected to the football helmet shell at locations adjacent to the upper corners of the face opening.

9. The football helmet of claim 8 wherein the faceguard comprises:

an upper portion comprising side bar parts and a center bar part;

raised eyebrow areas formed in the upper portion by an upward bend of the side bar parts with respect to the center bar part;

wherein the raised eyebrow areas are 0.5 inch to 1.5 inches above the center bar part.

10. The football helmet of claim 8 further comprising a front pad removably attached at the front portion of the shell, a crown pad removably attached at the crown portion of the shell, a pair of side pads removably attached at respective side portions of the shell, and a back pad removably attached at the back portion of the shell.

* * * * *